United States Patent [19]

Dilgard et al.

[11] 4,013,049

[45] Mar. 22, 1977

[54] MANIFOLD APPARATUS FOR MULTI-CYLINDER MOTORCYCLE ENGINES

[76] Inventors: Michael H. Dilgard, 13435 N. 31st Drive, Phoenix, Ariz. 85029; James W. Meir, 3001 W. Las Palmaritas, Phoenix, Ariz. 85021

[22] Filed: Aug. 28, 1975

[21] Appl. No.: 608,749

[52] U.S. Cl. ..... 123/52 M; 123/52 MV; 261/DIG. 36

[51] Int. Cl.[2] ..... F02B 75/18

[58] Field of Search .... 123/52 M, 52 MV, 122 AC; 261/DIG. 36

[56] References Cited

UNITED STATES PATENTS

| | | | |
|---|---|---|---|
| 1,802,024 | 4/1931 | Kreis | 123/52 M |
| 2,272,418 | 2/1942 | Mery | 123/52 M |
| 3,141,449 | 7/1964 | Dika | 123/52 M |
| 3,931,799 | 1/1976 | Tamai | 123/52 M |

FOREIGN PATENTS OR APPLICATIONS

| | | | |
|---|---|---|---|
| 1,286,368 | 4/1961 | France | 123/52 M |
| 1,132,643 | 9/1955 | France | 123/52 M |

*Primary Examiner*—Ronald H. Lazarus
*Attorney, Agent, or Firm*—H. Gordon Shields

[57] ABSTRACT

Intake manifold apparatus having a plurality of upwardly extending headers connected to a single distribution manifold for use with a downdraft carburetor on a multi-cylinder motorcycle engine.

9 Claims, 5 Drawing Figures

MANIFOLD APPARATUS FOR MULTI-CYLINDER MOTORCYCLE ENGINES

BACKGROUND OF THE INVENTION

1. Field of the Invention

This invention relates to motorcycle engines of the internal combustion type having a plurality of cylinders, and, more particularly, to an intake manifold for such an internal combustion engine using only a single carburetor.

2. Description of the Prior Art

Relatively small, air cooled internal combustion engines used to provide motive power for motorcycles typically have a carburetor for each cylinder in multi-cylinder engines. There are obvious disadvantages involved with having a plurality of carburetors, such as excessive fuel consumption, adjustment in balancing of multiple carburetors, and costs involved in both the purchase of multiple carburetors and the maintenance on the multiple carburetors. One of the limitations involved in providing only a single carburetor for multiple cylinders, such as is done with multi-cylinder internal combustion engines used to provide motive power for automobiles, is the space limitation of providing a manifold which is able to allow for the transmission of an adequate fuel and air mixture from a single carburetor to each of the plurality of cylinders.

Due to the space limitations, the carburetors typically used for motorcycle applications are side draft carburetors rather than the downdraft carburetor such as used in automotive applications. There are many downdraft carburetors available from a variety of manufacturing sources, and the ability to adapt a downdraft carburetor to multi-cylinder motorcycle engines is accordingly highly desirable. To take a stock downdraft carburetor, rework the jets, and fit such modified carburetor to a motorcycle engine is highly desirable from several standpoints, such as efficiency, cost, and maintenance, since a downdraft carburetor is less expensive than a sidedraft carburetor, is more efficient in use, and there are obviously less problems of maintenance, balancing, and tuning of a single carburetor, as opposed to multiple carburetors for a single engine.

SUMMARY OF THE INVENTION

The apparatus described and claimed herein discloses an intake manifold extending between a single downdraft carburetor and a plurality of cylinders in an internal combustion engine, including a chamber disposed beneath the carburetor, and a plurality of intake manifold runners or headers each extending outwardly and then upwardly from the chamber, and each terminating in another outwardly extending portion which is secured to each of the plurality of intake ports for the cylinders of the engine.

Among the objects of the present invention are the following:

- To provide new and useful manifold apparatus for an internal combustion engine;
- To provide new and useful intake manifolds for a downdraft carburetor;
- To provide new and useful manifold apparatus for connecting a single carburetor to a plurality of cylinders; and
- To provide new and useful manifold apparatus including an upwardly extending portion.

DESCRIPTION OF THE PREFERRED EMBODIMENT

Figure 1:
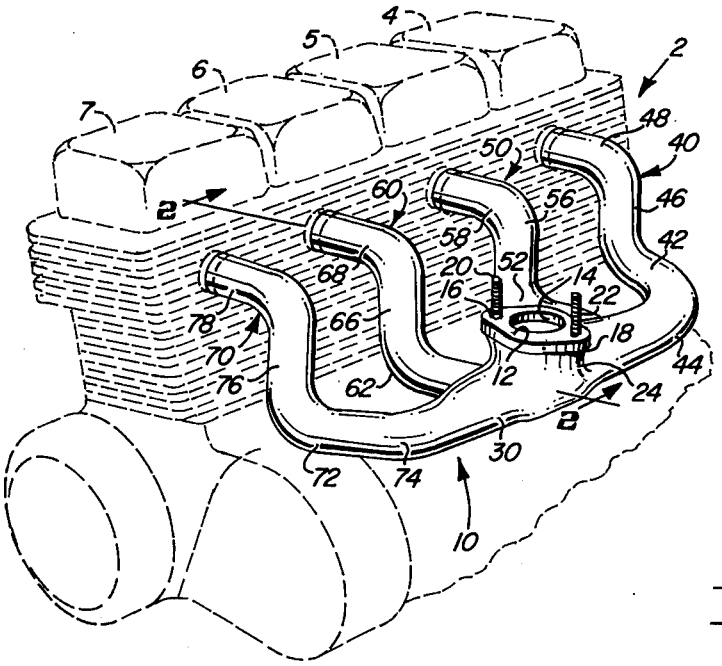
FIG. 1 is a perspective view of the intake manifold apparatus of the present invention illustrated in a use environment as connected to a multi-cylinder engine.

FIG. 1 is a perspective view of manifold apparatus 10 of the present invention illustrated in the environment of a multi-cylinder, air cooled engine, such as is commonly used for certain motorcycle applications. The engine 2 includes a cylinder block having four cylinders, respectively cylinders 4, 5, 6, and 7. Manifold apparatus 10 is shown secured to the cylinders of the engine, which is outlined only in phantom in FIG. 1.

The manifold apparatus 10 includes a flange 12 to which is secured a down-draft carburetor. The flange 12 is flat on the top and is of a general elliptical configuration, which includes a pair of ends, end 16 and end 18, which extend outwardly from the central portion of the flange. A pair of threaded studs 20 and 22 extend upwardly from the flange from the respective ends 16 and 18. The carburetor is secured to the flange with appropriate gaskets, and is bolted to the flange on the studs 20 and 22. A circular aperture 14 extends centrally through the flange. When a carburetor is disposed on and secured to the flange, the fuel and air from the carburetor flow downwardly from the carburetor, and into the manifold apparatus 10 through the aperture 14.

Beneath the flange 12 is an intermediate or connector portion 24 which communicates with a primary distribution manifold 30. The primary distribution manifold 30 is generally perpendicular to the connector portion 40, and extends generally parallel to the bank of cylinders 4, 5, 6, and 7 of the engine 2. Connected to the primary distribution manifold, and extending outwardly from the manifold 30 and upwardly to the respective cylinders of the engine, are a plurality of manifold headers 40, 50, 60, and 70. The headers are secured respectively to the intake valves of the cylinders 4, 5, 6, and 7. The headers are of a generally circular cross section, as clearly shown in FIGS. 2, 3, 4, and 5.

The primary distribution manifold 30 is generally cylindrical in configuration, and is of substantially larger diameter than the diameter of the headers 40, 50, 60, and 70. The manifold 30 is disposed with its longitudinal axis generally horizontal. The headers 40 and 70 connect to the opposite ends of the manifold 30, and the headers 50 and 60, which are between the headers 40 and 70, connect with the manifold 30 at one side thereof. The headers are spaced apart from each other and are generally of the same diameter.

Each of the headers include three primary portions, a horizontally extending portion, denoted generally by reference numerals 42, 52, 62, and 72, respectively. The horizontal portions 52 and 72 connect directly with the manifold 30. The outer headers 40 and 70 also include an angular portion respectfully designated by reference numerals 44 and 74, which connect with the portions 42 and 72, respectively, and with the primary distribution manifold 30. The angular portions 44 and 74 are also horizontally extending, and are disposed between the manifold 30 and the header portions 42 and 72, respectively.

Each of the headers also include a vertically extending portion, respectfully designated by reference numerals 46, 56, 66, and 76. These headers also include another horizontally extending portion which comprises an upper horizontally extending portion, designated respectfully by reference numerals 48, 58, 68, and 78, of the headers 40, 50, 60 and 70, connected to the vertically extending portions at their respective upper ends. The inside diameter of each of the various header portions is substantially uniform from the juncture of the various headers and the manifold 30 and outwardly and upwardly to where the headers connect with the respective cylinders. The elbows in the headers which join the respective header portions to each other are of a sufficient radius of curvature as to not hinder or impede the flow of fuel and air to the cylinders.

Figure 2:
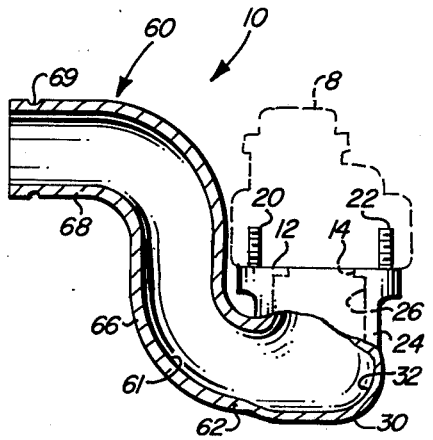
FIG. 2 is a view of a portion of the apparatus of FIG. 1 taken generally along line 2—2 of FIG. 1 and shown in partial section.

FIG. 2 is a view in partial section of a portion of the apparatus of FIG. 1, taken generally along line 2—2 of FIG. 1. The view is a side sectional view of the manifold apparatus through a header 60, the distribution manifold 30, and the flange 12 and connector portion 24.

Extending upwardly from the flange 12 are the studs 20 and 22, to which is secured a downdraft carburetor 8, illustrated in phantom in FIG. 2. The aperture 14 extends downwardly through the flange 12 and beneath the carburetor 8 to provide communication with the intermediate or connector portion 24 and with the primary distribution manifold 30 beneath the connector portion 24. The aperture 14 provides for the flow of fuel and air through a carburetor 8 into the interior of the manifold apparatus 10, and specifically into a conduit 26 which comprises the interior of the connector portion 24. The conduit 26 in turn communicates with the interior of the primary distribution manifold 30, which comprises a manifold chamber 32.

A single header 60 is shown connected to the distribution manifold 30. The header 60 includes an outwardly extending and generally horizontal portion 62, the interior of which communicates directly with the manifold chamber 32. The vertically extending portion 66 in turn is secured to and joins the horizontal extending portion 62. The vertical extending portion 66 extends above the flange 12. Finally, the upper horizontal portion 68 extends outwardly from its juncture with the vertically extending portion, or away from, the carburetor 8 and toward, as viewed in FIG. 1, the cylinder of the engine to which it is ultimately connected. The interior of the header, comprising the respective lower horizontally extending portion 62, the intermediate upwardly extending portion 66, and the upper horizontal extending portion 68, defines on the inside of the header a channel or conduit 61 which communicates with the manifold chamber 32 of the manifold 30 and provides for the flow of fuel and air from the carburetor 8 and from the manifold 30 into a cylinder of the engine to which the header is connected. Header 60 connects to cylinder 6 of the engine 2, as shown in FIG. 1, by means of a flexible connection secured to the cylinder and to the header by means of a circumferentially extending groove 69 located adjacent the distal end of the upper horizontally disposed portion 68 of the header 60 remote from the manifold chamber 32 of the manifold 30. The respective segments or portions of the header are connected by appropriate curved portions between the respective segments to allow for the smooth flow of the fuel and air therethrough.

Figure 3:
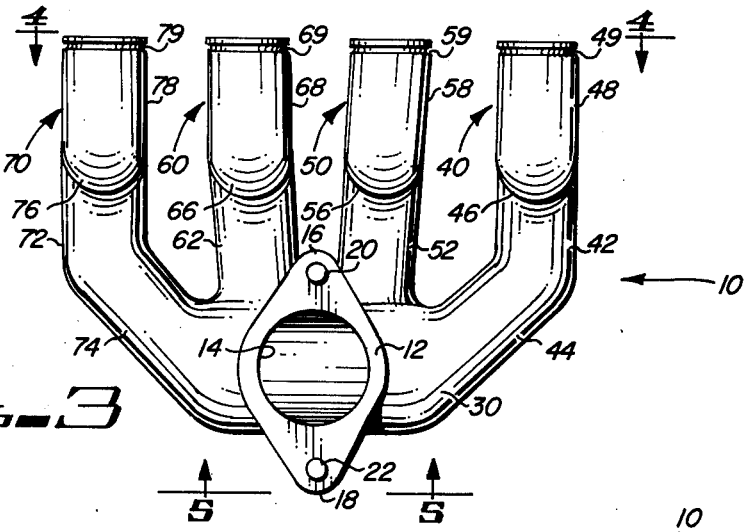
FIG. 3 is a top view of the manifold apparatus of FIG. 1.

FIG. 3 is a top view of the manifold apparatus of FIG. 1. The elliptical configuration of the flange 12 is clearly shown in FIG. 3, with its respective ends 16 and 18 extending outwardly or away from the aperture 14, which extends through the flange. The threaded studs 20 and 22 extend upwardly respectively from the ends 16 and 18.

Beneath the flange 12 is the cylindrical primary distribution manifold 30, to which the respective headers 40, 50, 60, and 70 are connected.

Headers 40 and 70 are connected to the outer ends of the cylindrical manifold 30, while the headers 50 and 60 connect to the manifold 30 at one side thereof, and between or intermediate the headers 40 and 70. The header 40 includes a horizontally and angularly extending portion 44 which connects at one end directly with the distribution manifold 30. The portion 44 of the header 40 extends away from the manifold 30 from one end of the manifold at an angle of about 45° to the longitudinal axis of the manifold. As indicated above, and as illustrated in FIG. 1, the portion 44 is generally horizontally extending. Connected to the horizontally extending portion 44 is another horizontally extending portion 42 which is also connected at an angle with respect to the portion 44 and is also about 45° to the intermediate horizontal portion 44. With respect to the axis of the manifold 30, the lower horizontally extending portion 42 of the header 40 is about 90° from the longitudinal axis of the manifold 30. That is, with the portion 44 extending about 45° to the longitudinal axis of the manifold 30, and the portion 42 extending about 45° with respect to the longitudinal axis of the portion 44, and in the same relative direction away from the axis of the manifold 30 as is the portion 44, the portion 42 is about perpendicular to the longitudinal axis of the manifold 30. Between the lower portion 42 and the upper portion 48, which are generally parallel to each other, is a vertically extending portion 46. The various portions of the header 40 are of substantially the same diameter so as to define within the header a generally smoothly configured conduit to provide for the flow of fuel and air from the carburetor, through the manifold 30, and through the header into a cylinder (cylinder 4 of FIG. 1) to which the header is connected remotely from the manifold 30.

As can be clearly seen in FIG. 3, the diameter of the header 40 is substantially less than the diameter of the primary distribution manifold 30.

Adjacent the ends of the respective headers, remote from the manifold 30, are circumferentially extending grooves 49, 59, 69, and 79, which are used to secure the headers and the manifold apparatus to the respective cylinders of an engine. Typically, the cylinders include a short outwardly extending connector portion in the form of a short tube or runner, and a flexible connection then extends between the tube and the manifold. With the existing fastening means that are typical with the motorcycle engines, the grooves 49 . . . 79 may be used to secure the header apparatus 10 to the cylinders of an engine. A snap ring or other type of securing means provides a bias for biasing the portion of a flexible connector into the respective grooves 49 . . . 79, and accordingly the connector is secured to the header apparatus. As indicated above, the grooves are circumferentially extending about the headers at the distal end of the upper horizontal portions of each header, remote from the primary distribution manifold 30.

The intermediate or inside headers 50 and 60 also are shown in FIG. 3 to diverge slightly from each other. This may be required for appropriate spacing of the distal ends of the headers, adjacent the grooves 49 . . . 79, for connection to the respective cylinders.

Figure 4:
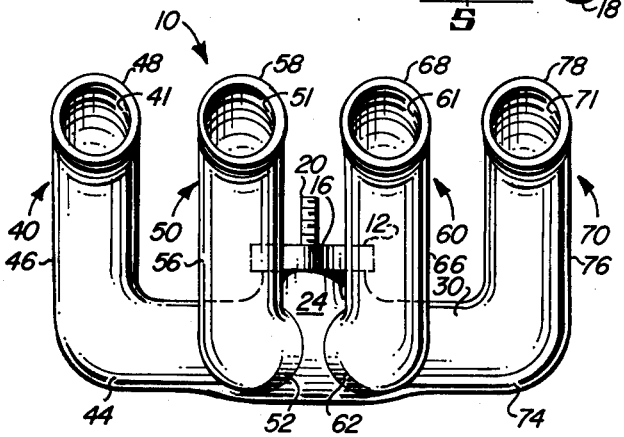
FIG. 4 is a view of the manifold apparatus of FIG. 3 taken generally along line 4—4 thereof, and comprising a front view of the manifold apparatus.

FIG. 4 is a view of the manifold apparatus of FIG. 3 taken generally along line 4—4 of FIG. 3, comprising a side elevation view of the manifold apparatus 10, looking toward the manifold apparatus from the engine. In FIG. 4, the flange 12 is shown extending slightly above the distribution manifold 30 with the intermediate or connector portion 24 between the flange and the manifold. The end 16 of the flange 12 is shown with threaded stud 20 extending upwardly therefrom. The four headers, 40, 50, 60 and 70 are shown respectively connected to the manifold from one axial end of the manifold, from the center portion of the manifold, and from the other axial end of the manifold. The headers are connected to the manifold 30 by, respectively, portions 44, 52, 62, and 74, all of which are substantially of the same diameter, with respect to each other, and are of less diameter than the manifold 30.

Each of the headers includes a vertically extending portion, 46, 56, 66, and 76, respectively. The vertically extending portions have their lower extremities or bottoms even with the distribution manifold 30, and their upper extremities or tops above the flange 12 so as to allow a carburetor to be disposed in the flange and secured thereto, and, as illustrated in FIG. 2, still provide a relatively compact total carburetor and manifold package.

Each of the headers includes an outwardly extending horizontal portion, including portions 48, 58, 68, and 78, which extend from the vertically extending portion to the respective cylinders of the engine to which the apparatus is secured. Within the headers is a conduit, respectively identified as conduits 41, 51, 61, and 71, which extend from the manifold chamber 32 (see FIG. 2) of the distribution manifold 30 to the cylinders of the engine to which the apparatus is secured to provide a conduit for the flow of fuel and air from the carburetor to the cylinders.

Figure 5:
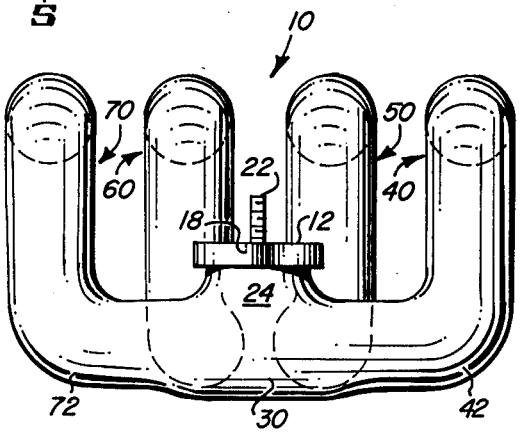
FIG. 5 is a view of the apparatus of FIG. 3 taken generally along line 5—5 of FIG. 3 and comprising a rear view of the manifold apparatus of the present invention.

FIG. 5 is a side view of the apparatus of FIG. 3 taken generally along line 5—5 thereof, in comprising another elevation view of the manifold apparatus of the present invention, but from the opposite direction from the view shown in FIG. 4. The primary distribution manifold 30 of the manifold apparatus 10 is shown with its plurality of headers 40, 50, 60, and 70 extending away from and upwardly with respect to the distribution manifold 30. The flange 12 is disposed above the manifold 30, with the intermediate or connector portion 24 between the flange and the distribution manifold 30. The end 18 of the flange is illustrated with the threaded stud 22 extending upwardly from the end 18 of the flange.

The manifold apparatus disclosed herein is relatively compact and easily installed on a motorcycle engine. It allows a single downdraft carburetor to be used with a multi-cylinder motorcycle engine rather than the plurality of side draft carburetors presently used on multi-cylinder motorcycle engines. Obviously, the apparatus may be adapted to an engine with more or less than the four cylinders shown herein.

While the principles of the invention have been made clear in illustrative embodiments, there will be immediately obvious to those skilled in the art many mofidications of structure, arrangement, proportions, the elements, materials, and components used in the practice of the invention, and otherwise, which are particularly adapted for specific environments and operating requirements, without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. In an internal combustion engine having a cylinder block and a carburetor spaced apart from the cylinder block, manifold apparatus extending between the carburetor and the cylinder block, comprising, in combination:

flange means, including
- a flange to which the carburetor is secured, and
- an aperture extending through the flange through which fuel and air flows from the carburetor;

chamber means disposed beneath the flange means for receiving the fuel and air flow from the carburetor;

header means connected to and communicating with the chamber means and extending to the cylinder block and including
- a first portion connected to the chamber means and extending generally horizontally outwardly from the chamber means,
- a second portion connected to the first portion and extending generally vertically from the first portion to above the flange, and
- a third portion connected to the second portion and extending generally horizontally above the flange and to the cylinder block.

2. The apparatus of claim 1 in which the flange means includes means for securing the carburetor to the manifold apparatus.

3. The apparatus of claim 1 in which the third portion of the header means includes means for securing the manifold apparatus to the engine.

4. The apparatus of claim 1 in which the chamber means is generally cylindrical in configuration and has a longitudinal axis which is horizontally disposed.

5. The apparatus of claim 4 in which the header means is of a generally circular cross section and the diameter of the chamber means is larger than the diameter of the header means.

6. The apparatus of claim 5 in which the flange means further includes a connector portion between the flange and the chamber means.

7. The apparatus of claim 1 in which the header means includes a plurality of headers extending from the chamber means to the cylinder block, and each header includes the respective first portion, second portion, and third portion.

8. The apparatus of claim 7 in which the flange means includes a connector portion between the flange and the chamber means extends generally horizontally beneath the connector portion of the flange means and parallel to the cylinder block.

9. The apparatus of claim 8 in which the chamber means is generally cylindrical in configuration and the diameter of the chamber means is larger than the diameter of each of the headers.

* * * * *